United States Patent [19]

Bon

[11] 4,437,592

[45] Mar. 20, 1984

[54] SELF-SEALING ACTUATING DEVICE FOR MOUNTING ON A DISCHARGE VALVE OF A PRESSURIZED CONTAINER

[76] Inventor: Luigi D. Bon, 141 Feldstrasse, 4663-Aarburg, Switzerland

[21] Appl. No.: 218,083

[22] Filed: Dec. 19, 1980

[30] Foreign Application Priority Data

Dec. 21, 1979 [CH] Switzerland ..... 11369/79
May 16, 1980 [CH] Switzerland ..... 3819/80

[51] Int. Cl.[3] ..... B65D 83/14

[52] U.S. Cl. ..... 222/402.12; 222/402.13; 222/402.23; 222/476; 222/514; 222/509

[58] Field of Search ..... 222/402.1, 402.12, 402.13, 222/509, 149–151, 514, 518, 524–525, 528–529, 476, 402.2, 402.23; 251/354, 350, 353; 239/337, 338, 350, 353, 574, 573

[56] References Cited

U.S. PATENT DOCUMENTS 3,361,301 1/1968 Meshberg ..... 222/402.13 X
3,490,658 1/1970 Schwartzman ..... 222/402.12
3,515,316 6/1970 Green ..... 222/402.12 X
3,558,059 1/1971 Pfaff ..... 222/213 X

FOREIGN PATENT DOCUMENTS 2450841 5/1975 Fed. Rep. of Germany ..... 239/573
62981 7/1955 France ..... 222/402.20

*Primary Examiner*—Charles A. Marmor
*Attorney, Agent, or Firm*—Heinrich W. Herzfeld

[57] ABSTRACT

A self-sealing actuating device is adapted for being mounted on the valve-body of a conventional pressurized container valve from which liquid product is dispensed with a propellant, in liquid, pasty or foamy condition. The device opens automatically when an external part thereof is moved, and comprises (a) as said external part, an actuating tube having a discharge orifice;

(b) an obturating member lodged stationary in a tubular passage of the actuating tube, having an obturating head obturating the discharge orifice from the outside, and (c) a spring device biassing the actuating tube toward closed position when the actuating device is opened; when the actuating tube is moved toward open position, the obturating head frees the discharge orifice with the compression of the spring device.

15 Claims, 10 Drawing Figures

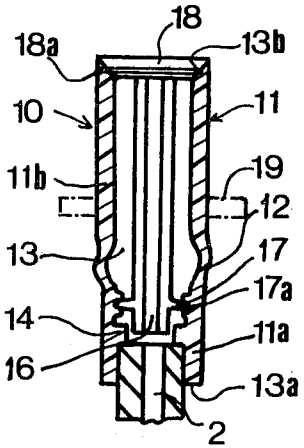
FIG.2
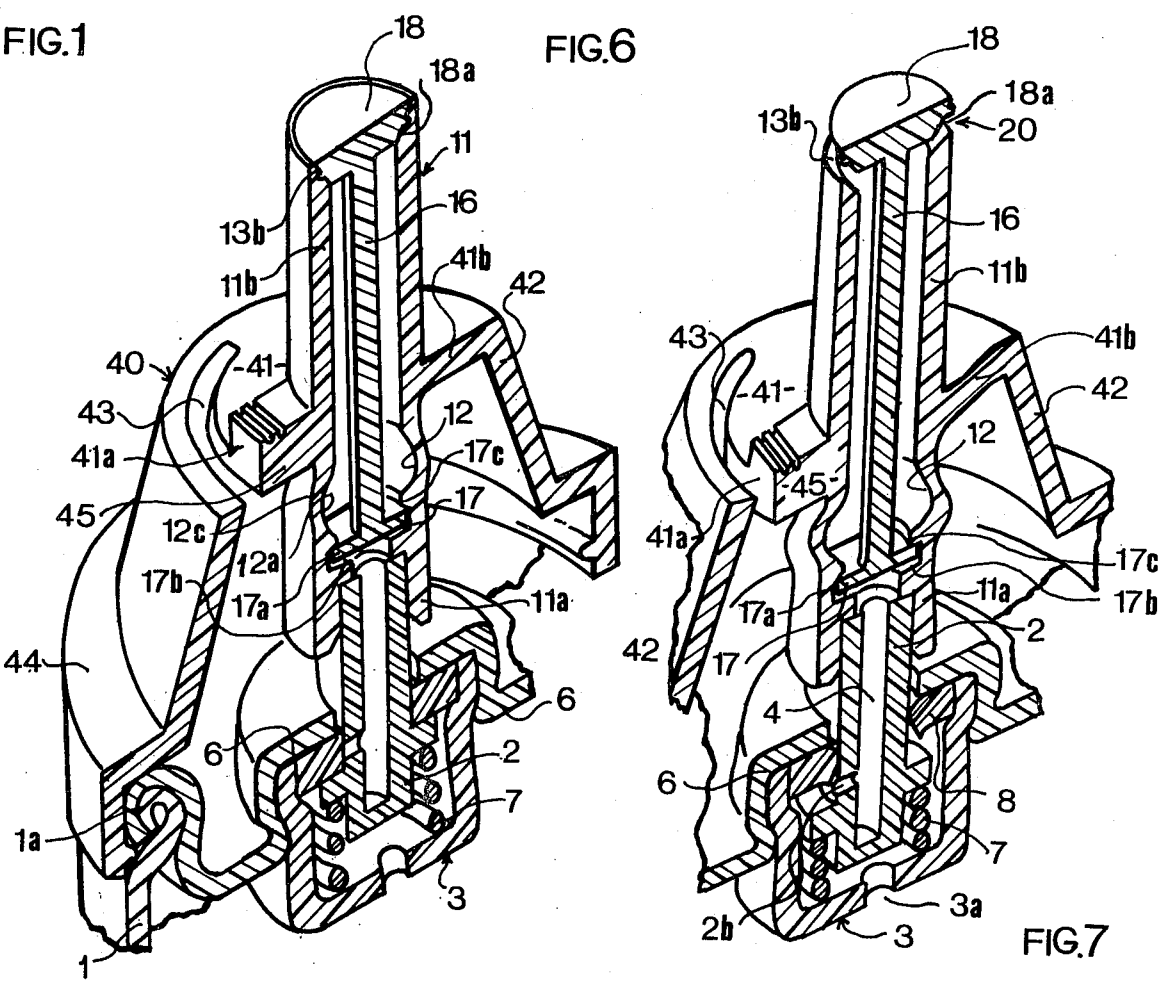
FIG.1
FIG.6
FIG.2
FIG.7

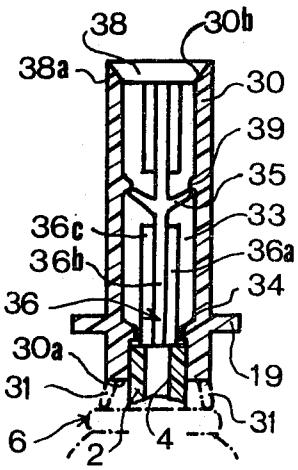
FIG.4
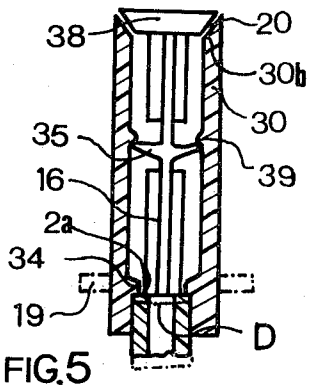
FIG.5
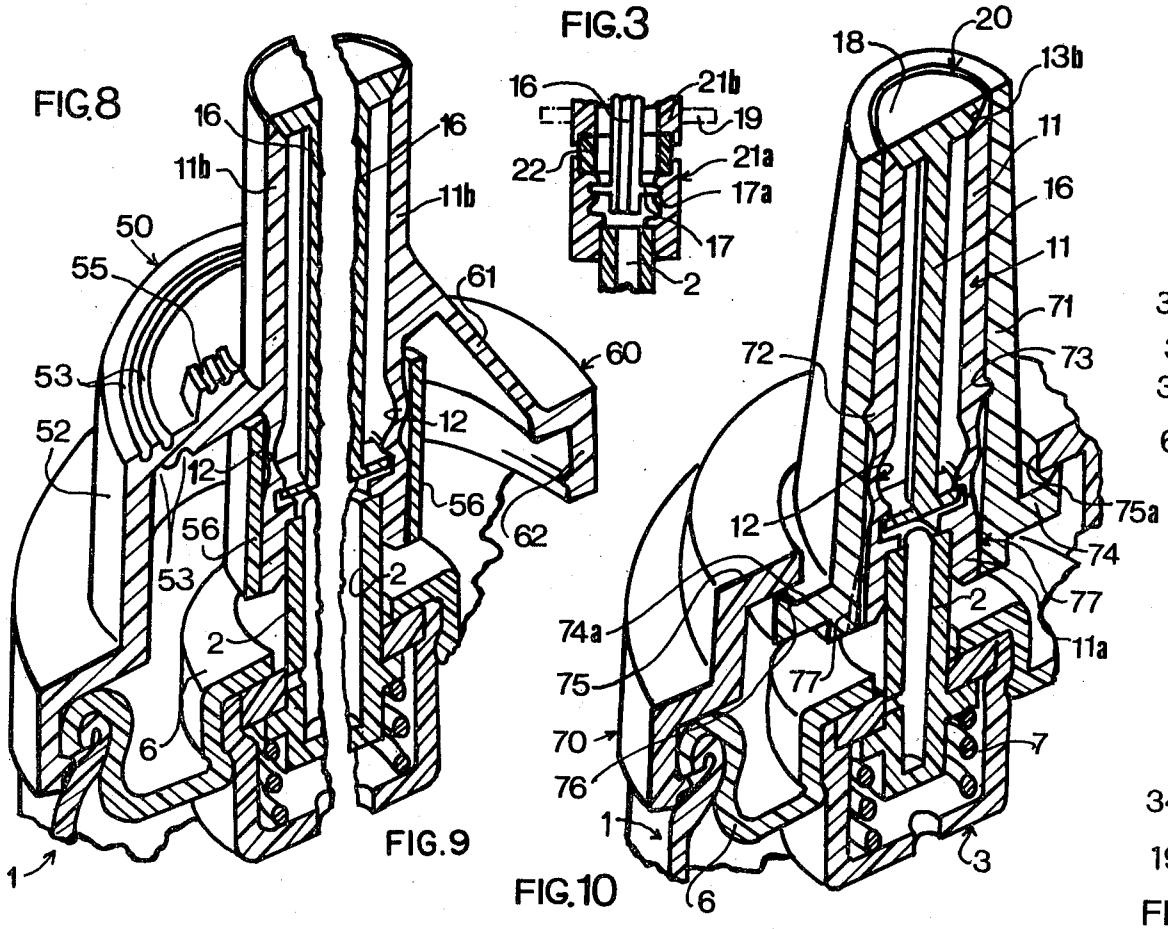
FIG.3
FIG.8
FIG.9
FIG.10

SELF-SEALING ACTUATING DEVICE FOR MOUNTING ON A DISCHARGE VALVE OF A PRESSURIZED CONTAINER

BACKGROUND OF THE INVENTION

This invention relates to a self-sealing actuating device adapted for being mounted on the valve body, having an outlet channel, of a self-closing discharge valve of a pressurized container from which a liquid product is to be dispensed with the aid of a propellant, in liqud, pasty or foamy condition, which actuating device opens automatically when an external part of the device is moved, preferably by fingers of a user's hand, in a given direction.

As far as the inventor knows, such automatically openable actuating device is novel. The invention also relates to an actuating system comprising a self-closing discharge valve of a pressurized container and a novel self-sealing actuating device of the aforesaid type mounted on the discharge valve.

OBJECTS AND SUMMARY OF THE INVENTION

It is an object of the instant invention in its various aspects to provide an actuating device and a discharge system containing such device which is free from drawbacks occurring in the discharge of liquid product from a pressurized container with the aid of a propellant, in liquid, pasty or foam condition; these drawbacks consist in particular in residual product left in the discharge channel and discharge orifice downstream of, i.e. outside, the sealing zone of the discharge valve proper. Such residual product is usually exposed to the outside air, it can dry out, age or be subject to bacterial composition and is thus liable to clog the discharge orifice or contaminate a subsequent batch of product being discharged. Such disadvantage occurs, for instance, in the discharge of foam of shaving lather stored in a pressurized can.

Thus, it is unavoidable, after leaving a pressurized can containing such lather unused for a prolonged time, that it is a portion of the already aged and/or decomposed foam residue that is applied first to the skin of the user's face or other parts of the user's body, which aged and/or decomposed portion is then covered by new foam and intermingled with the latter.

At the same time, it is an object of the instant invention to provide an actuating device and a discharge system comprising such device, which permits practically complete emptying of the container containing the product regardless of the excess pressure above ambient pressure prevailing in the same.

Another drawback to be avoided is the tendency of the discharge to be particularly strong in the initial stages of discharging product from the container. Due to high excess pressure prevailing in the full or still largely filled container, product is often discharged in the form of a jet with unsatisfactory foam formation, or foam discharge is prolonged, even after re-closing of the discharge valve.

The self-sealing actuating device of the initially described type comprises, in accordance with the invention, (a) as said external part, a tubular actuating member having two open ends one of which is destined to register with the said outlet channel, when said actuating device is mounted on said valve body, the other open end constituting a discharge orifice; and a tubular passage connecting said two open ends;

(b) an obturating member lodged axially displaceably, between an open position and a closed position, in said tubular passage and having an obturating head for obturating said discharge orifice hermetically from the outside, when said obturating member is in closed position, and (c) spring means associated with at least one of said tubular actuating member and said obturating member and adapted for biassing said members toward said closed position when said actuating device is brought into the open position;

whereby, when said tubular actuating member is moved toward the open position, by an axial force directed away from said discharge orifice, against bias applied to said tubular member by said spring means, said obturating head is moved out of said discharge orifice with tensioning of said spring means, and said discharge orifice is freed in the form of an annular gap.

In a preferred embodiment of the invention, the tubular actuating member has a conically inwardly tapered valve seat about said discharge orifice, on which seat the said obturating head of the obturating member sits sealingly when in closed position.

In a first embodiment, the obturating member can have spring tongue means projecting outwardly from the member, and the tubular passage has an internal wall and comprises tongue-engaging means projecting inwardly from that inner wall and engaging the spring tongue means, whereby the spring tongue means are biassed toward closing position when the obturating member moves in outward direction relative to the tubular actuating member.

In a best preferred embodiment, the tubular member comprises an elastically foldable wall zone acting as spring means as defined under (c), whereby, upon force being exercised on the actuating member to disengage the obturating head from the discharge orifice, the foldable wall zone is compressed with corresponding axial shortening of the actuating member. The obturating member preferably comprises anchoring means for rigidly anchoring the member is said tubular actuating member; the anchoring means engage the actuating member in a zone thereof on the end of the foldable wall zone remote from the discharge orifice.

Each of the actuating member and the obturating member can be an integral part made of synthetic plastics material. Preferably, however, the obturating member is integrally made of synthetic hard plastics material, while the tubular actuating .nember consists essentially of two rigid tubular parts each made integrally of synthetic hard plastics material, and of an annular wall part made of elastically deformable synthetic or natural plastics material, one of the said rigid tubular parts comprising at one end thereof the discharge orifice, and having its other end joined to one end of the annular wall part, the other end of the annual wall part being joined to the other rigid tubular part.

In a further aspect, the invention relates to a discharge system comprising (I) a self-closing discharge valve for use with a pressurized container, from which container a liquid product is to be dispensed with the aid of a propellant in liquid, pasty or foamy condition, which discharge valve comprises a valve body having an outlet channel, a valve seat, and a valve spring means biassing the valve body into a closing position on the valve seat; and (II) a self-sealing actuating device mounted on the valve body, and comprising (a) a tubular actuating member having two open ends one of which is destined to register with the said outlet channel, the other open end constituting a discharge orifice; and a tubular passage connecting said two open ends;

(b) an obturating member lodged axially displaceably, between an open position and a closed position, in the said tubular passage and having an obturating head for obturating the discharge orifice hermetically from the outside, when the obturating member is in closed position, and (c) actuating spring means associated with at least one of said tubular actuating member and said obturating member and adapted for biassing these members towards their respective closed positions when said actuating device is brought into the open position;

whereby, when the tubular actuating member is moved toward the open position, the obturating head is moved out of the discharge orifice with tensioning of the actuating spring means, by an axial force directed away from the discharge orifice toward the discharge valve, against bias applied to the tubular member by the valve body and the valve spring means, and whereby the discharge orifice is freed in the form of an annular gap.

Preferably, the tubular actuating member has a conically inwardly tapered valve seat about the discharge orifice, and the obturating head has a frontal face, and a rear face directed toward the tubular passage, which rear face bears a conically bevelled zone adapted for hermetically sealingly engaging the tapered valve seat of the tubular actuating member, when in closed position.

The strength of the valve spring means and the strength of the actuating spring means are preferably so proportioned relative to one another that disengagement of the valve body from its valve seat occurs, against the action of the valve spring means, at the earliest when the obturating head frees the discharge orifice with formation of the said annular gap.

Optimally, the strengths of the valve spring means and the actuating spring means are so proportioned relative to each other that disengagement of the valve body from its valve seat occurs only after the obturating head frees the discharge orifice with formation of the said annular gap.

Similar to a first embodiment of the first aspect of the invention, described hereinbefore, the obturating member can have spring tongue means projecting outwardly from the valve body, and the tubular passage can have an integral wall and can comprise tongue-engaging means projecting inwardly from the said inner wall and engage the spring tongue means, whereby the latter means are biassed toward closing position when the obturating member moves in outward direction relative to the tubular actuating member.

and, in this embodiment, the tubular passage can have an inwardly projecting annular shoulder which, in closed position, extends spacedly above the valve body about the said outlet channel therein, while, in opening position, the said annular shoulder engages the valve body and depresses it against the action of the valve spring means, thereby opening the discharge valve.

In a most preferred embodiment of the discharge system according to the invention, the tubular member comprises an elastically foldable wall zone acting as spring means as defined under (c), whereby, upon force being exercised on the actuating member to disengage the obturating head from the discharge orifice, the foldable wall zone is compressed with corresponding axial shortening of the actuating member; and the obturating member comprises anchoring means for rigidly anchoring the obturating means in the tubular actuating member, with the said anchoring means engaging the actuating member in a zone thereof on the side of the foldable wall zone remote from the discharge orifice;

while, upon further force being exercised on the actuating member in the direction toward the valve body, the tubular actuating member will move the valve body against the action of the valve spring means to open the discharge valve.

The tubular actuating member preferably comprises an outer hull about the tubular passage, as well as contact means connected with the outer hull in the region thereof between the discharge orifice and the elastically foldable wall zone, which contact means are depressable by the fingers of a user's hand.

The discharge valve can comprise mounting means adapted for mounting the valve in the wall of a pressurized container, and the above-mentioned contact means can be a finger cap having a circumference a part of which is rigidly connected to the said mounting means, whereby finger-pressure exerted on the cap moves the actuating member with tilting and compression of the foldable wall zone toward open position, and, in this case, the valve body of the discharge valve is preferably tiltable, so that tilting of the valve body under pressure of the said actuating member after full compression of the foldable wall zone of the latter causes opening of the discharge valve. The tubular actuating member and the finger cap are preferably made integrally and from synthetic plastics material.

In a particularly preferred embodiment, the said cap comprises a roof portion and a cap side wall, the periphery of which roof portion is connected with said cap side wall by a bridging segment, the remainder of the roof portion and side wall being separated from one another by an arcuate slot.

The novel device and system according to the invention guarantee a clean, hermetic closing of the discharge orifice, the avoidance of undesirable air pockets in the actuating device and of undesirable pressure increase in product enclosed in the interior of the device between the closed discharge orifice of the actuating device and the closed discharge valve of the pressurized container.

The staggered opening, first of the discharge orifice of the actuating device, and subsequently only, of the discharge valve of the pressurized container, and closing of these obturating means in reverse sequence, has the advantage that foam portions residual in the actuating device after the container discharge valve has closed can be fully pressure-relieved before the outer discharge orifice of the actuating device is in turn closed. Thus a subsequent pressure increase in the interior of the actuating device is rendered practically impossible.

Moreover, the aforesaid "staggered" closing of the two closure means, first the discharge valve and then the discharge orifice of the actuating device, permits the residual foam downstream of the discharge valve, in the interior of the tubular actuating member, to expand fully, with release of larger occluded air bubbles to the outside, and to occupy the remaining spaces inside the said member in substantially unpressurized condition, after closing of the discharge orifice.

On the other hand, upon renewed actuation of the discharge system, the enclosed untensioned foam residue will be expelled slowly under pressure of further product penetrating into the interior of the actuating member after the discharge valve of the pressurized container has opened, and there will be no back-up of product and no pressure increase, owing to the fact that the discharge orifice of the actuating device is already open before the discharge valve of the container opens.

BRIEF DESCRIPTION OF THE DRAWINGS

Further details of the actuating device and discharge system according to the invention will be explained in the following description of preferred embodiments of the same illustrated in the accompanying drawings. In these drawings FIG. 1 is an axial sectional view of a first, preferred embodiment of an actuating device according to the invention, with the parts in "closed" position;

FIG. 2 is a similar view of the same embodiment, but with the parts in "open" position;

FIG. 3 a partial view of a somewhat different arrangement of actuating spring means in an embodiment which is similar to that of FIGS. 1 and 2 in all other respects;

FIG. 4 is an axial sectional view of another embodiment of an actuating device, with the parts in "closed" position;

FIG. 5 is a similar view of the embodiment shown in FIG. 4, with the parts in "open" position;

FIG. 6 is a perspective view, in axial section, of a preferred embodiment of a discharge system according to the invention, which contains the actuating device shown in FIGS. 1 and 2, with the entire system being in "closed" position;

FIG. 7 is a similar view of the system shown in FIG. 6, but in "open" position;

FIG. 8 is a similar view as FIG. 6, but of a further embodiment of a discharge system, in "closed" position;

FIG. 9 is a similar view of a third embodiment of such discharge system, also in "closed" position; and FIG. 10 is a similar view of a fourth embodiment of such discharge system, also in "closed" position.

The terms "upper" and "lower" in the following description of the drawings refer to the position of parts shown in the figures of the drawings. "Outward" and "inward" refer to the direction of movement away from or toward the interior of the pressurized can the discharge valve of which is to be provided with the actuating device of the invention.

DETAILED DESCRIPTION OF THE EMBODIMENTS SHOWN IN THE DRAWINGS

The preferred embodiment of an actuating device 10 which is shown in FIGS. 1 and 2 comprises a tubular actuating member 11 which can be mounted fixedly and sealingly on the free end of the valve body 2 of a discharge valve 3 which in turn is mounted in a conventional manner in the wall of a pressurized can 1 or the like container (see also FIG. 6).

In order to ensure rigidity, the lower portion **11*a* of tubular member 11 which is preferably made of synthetic resin material is of adequate wall thickness, and so is the upper portion 11*b* of tubular member 11, as this portion 11*b* must likewise be sufficiently stiff to permit being pushed downward without noticeable deformation. Between portions 11*a* and 11*b* there is an intermediate wall zone 12 of reduced wall thickness. This weakened wall zone is therefore elastically foldable, so that, upon pressure being exercised in downward direction on portion 11*b* of member 11, the wall zone 12 will be folded and compressed to shorten the overall length of tube 11**.

Tubular member 11 has a central passage 13 opening in the end face **13*a* of lower tubular member portion 11*a*, on the one hand, and in the upper end of upper portion 11*b*, on the other hand, at which upper end there is provided a conically inwardly tapered seat 13*b***.

Below the wall zone 12, an annular shoulder 14 projects from the wall of tubular member portion **11*a* radially inwardly, and can be placed with its underside on the top end face of valve body 2**.

An elongated obturating member 16 is lodged in the interior 13 of tubular member 11 and bears at or near its lower end holding pins 17 which project into corresponding holes or an annular groove **17*a* in the inner wall of tubular member portion 11*a*, below the level of wall zone 12 and above the level of shoulder 14, thus connecting obturating member 16 firmly with the lower tubular member portion 11*a*, and preventing axial displacement of these parts relative to one another. At its upper end, obturating member 16 bears an obturating head 18 which protrudes from the upper end of central passage 13 and has a conically bevelled underside 18*a* which, in the "closed" position shown in FIG. 1, sealingly engages the seat 13*b* about the discharge orifice of central chamber 13**.

On the outside of tubular member upper portion **11*b* there is firmly attached or integrally molded a disk or pressure cap 19, which serves as a finger rest for depressing or tilting the upper portion 11*b* of actuating member 11. When the user thus actuates member 11, the foldable wall zone 12 will be compressed, either evenly or on one side and, thereby, the upper actuating member portion 11*b* will be moved substantially axially downwardly, withdrawing seat 13*b* at its upper end from the bevelled surface 18*a* of obturating head 18, thereby opening an annular gap therebetween constituting a discharge orifice through which liquid product, in particular foam or paste can pass to the outside from the interior passage 13 of actuating member 11. Upon further depression of upper portion 11*b* of the latter, as soon as foldable wall zone 12 has been maximally depressed at least on one side thereof, inwardly directed pressure will be exercised via stiff lower tubular member portion 11*a* on the valve body 2 of discharge valve 3 and the latter valve will be opened. Propellant in pressurized container 1 will then drive product from the container 1 into central passage 13 and will push any product present in the latter passage out through discharge orifice 20**.

A slight release of pressure on disk or cap 19 will permit a valve spring 7 which is mounted in a valve housing 6 of discharge valve 3 to raise valve body 2 to its "closed" position, while further relief of pressure on disk or cap 19 will then permit wall zone 12 to stretch and push seat **13*b* at the upper end of upper actuating member portion 11*b* sealingly against bevelled counterface 18*a* of obturating head 18, thus hermetically sealing discharge orifice 20 and protecting residual foam or the like product in central passage 13** from the deteriorating influence of the ambient atmosphere.

Preferably, even in its stretched condition, foldable wall zone 12 retains a slight initial fold, thus being slightly pretensioned to press seat 13*b* against bevelled surface 18*a* while discharge opening 20 remains closed.

Instead of using as actuating spring means a foldable wall zone as in the embodiment of FIGS. 1 and 2, there can be used an elastically axially deformable sleeve 22 which can be made, for instance, of highly elastic rubber. Lower portion 11*a* and upper portion 11*b* of actuating member 11 can then be replaced by two stiff tubular pieces 21*a* and 21*b* between which deformable sleeve 22 is mounted, as shown in FIG. 3.

Instead of a disk or pressure cap 19, two finger rests on opposite sides of actuating member 11 can likewise be provided.

In another embodiment of the actuating device according to the invention, which is shown in FIGS. 4 and 5, a stiff actuating tube can be mounted with an internal shoulder 34, projecting from the inner wall of central tube passage 33 inwardly, a slight distance above the top frontal face 2*a* of valve body 2 of a pressurized container discharge valve 3 indicated in phantom lines in FIG. 4. A central outlet channel 4 is at all times in free communication with the passage 33 in actuating tube 30, by way of the lower open ends of longitudinal grooves provided between longitudinal ribs 36*a*, 36*b*, 36*c* and 36*d* (not visible) of stiff obturating member 36. This member 36 bears an obturating head 38 having a conically bevelled obturating face 38*a* on its underside similar to the embodiment of FIGS. 1 and 2, which engages a conically inwardly tapered seat 30*b* at the upper end of actuating tube 30, when the discharge orifice 20 between the two sealing surfaces 30*b* and 38*a* is closed.

The spring means connecting obturating member 36 and actuating tube 30 with each other are provided by an annular shoulder or several shoulder segments 39 projecting inwardly from the inner wall of central passage 33 and slightly deflectable arms 35 which project radially from the obturating member 36 in a zone of the latter slightly below annular shoulder 39. Arms 35 are slanted upwardly with their free ends slightly above the underside of shoulder 39 before assembly of the actuating device, whereby, in the closed position, after assembly, the free ends of these arms 35 are engaged and slightly depressed by shoulder 39, whereby seat 30*b* of tube 30 is biassed into sealing engagement with counterface 38*a* of obturating head 38.

When operating the actuating device by pressing finger rest, disk or cap 19 downward, the underside of the annular shoulder 34 comes to rest on the top frontal face 2*a* of valve body 2, simultaneously moving seat 30*b* away from counter face 38*a*. The latter remains in unchanged position, as stiff obturating member 36 rests with the outer end portions of its ribs 36*a* to 36*d* firmly on the frontal face 2*a* of valve body 2, and discharge orifice 20 will thus be open as an annular gap between seat 30*b* and obturating head 38.

When the underside of shoulder 34 has come to rest on frontal face 2*a*, further depression of tube 30 causes valve body 2 to be moved downward and to open discharge valve 3 (FIG. 5). Discharge of product from pressurized container 1 via outlet channel 3 and central passage 33 out of discharge orifice 20, under the effect of propellant present in container 1 (see phantom lines D in FIG. 5 indicating the depressed position of valve body 2).

When the discharge of product, e.g. in foamy condition, is to be interrupted, the user's fingers will relieve pressure on the pressure means 19 and, correspondingly, the relatively strong valve spring 7 will urge valve body 2 upwardly and close valve 3. This will also raise both the actuating tube 30 and the obturating member 38 to the position shown in full lines in FIG. 5, in which the discharge valve 3 is closed while the discharge orifice 20 is still open.

Further, complete release of pressure means 19 will then allow tube 30 to be raised by the upwardly directed spring action of the free ends of arms 35 until discharge orifice 20 is hermetically closed.

During the short interval between the closing of the discharge valve 3 and the closing of the discharge orifice 20, the foam or the like product portion cut off from further propellant pressure can be fully decompressed in the central passage 33; as this cut-off product portion still extends out of discharge orifice 20, there is no time for it to be retracted, e.g. with defoaming, behind the discharge opening 20 into the central passage 33 during the short time before discharge orifice 20 is also closed. Thus there will be no suctioning-in of oxygen or bacteria from the outside air, and the deteriorating influence of the latter on the residual product in the passage 33 is avoided.

When actuating tube 30 is again depressed with successive opening of discharge orifice 20 and discharge valve 3, this residual foam forms a kind of resilient cushion which, on the one hand, prevents too sudden an ejection from the discharge orifice of pressurized product being expelled through the discharge valve, and, on the other hand, is pushed out of the discharge orifice almost without excess pressure.

In order to augment the bias of the spring arms 35 for reclosing the discharge orifice 20, auxiliary spring legs 31 can be provided at the underside 30*a* of actuating tube 30 which support the latter on a dome part 6 which serves as a lid for the pressurized can 1.

The actuating spring means may also consist of a combination of the foldable wall zone 12 of the embodiments of FIGS. 1 and 2, or 3 and of the spring arms 35 and internal tube shoulder 39 as shown in the embodiment of FIGS. 4 and 5. This embodiment has not been illustrated.

In the embodiment shown in FIGS. 1, 2, 4 and 5, the entire actuating device requires only two relatively simple parts which can be produced from cheap synthetic plastics masterials such as polyethylene, polypropylene or polyvinyl chloride with satisfactory accuracy by injection molding techniques. The narrow conical seat provided at the upper end of the actuating tube for engagement by the similarly bevelled obturating head warrants a satisfactory, hermetic seal even with relatively small bias of the actuating spring means.

As this bias need not be overcome by the foam or the like product being discharged as the discharge orifice of the actuating device opens, there never occurs the undesirable sudden product discharge which is a drawback of many known foam dispensers. At the same time, the residual foam portion enclosed in the closed device is sufficiently protected against drying or similar undesirable changes of its condition.

The preferred embodiment of a discharge system according to the invention which is illustrated in FIGS. 6 and 7 comprises the discharge valve 3, of conventional structure, of a pressurized can 1, and an actuating device substantially of the same structure as the embodiment thereof shown in FIGS. 1 and 2. Similar parts of this device are designated by like reference numerals.

The same applies to the (conventional) parts of the discharge valve 3.

As will be appreciated from a comparison of FIGS. 6 and 7, a relatively small folding of wall zone 12 of the actuating tube member 11 suffices to open a ring gap at the discharge orifice 20, before the discharge valve 3 opens, while this gap is widened, as shown in FIG. 7 when the discharge valve 3 is also opened. This is effected as shown in FIG. 7 when product under pressure by a propellant can pass from the can interior through an opening 3*a* in the bottom of the valve housing and through the interior of the latter to a radial duct 2*b* and through the latter, which is obturated in "closed" position by a flexible sealing gasket 8, but has been freed by continued downward movement of actuating tube 11 after compression of wall zone 12, pushing valve body 2 inwardly. The propellant-pressurized product then passes through outlet channel 4 of valve body 2 into the central passage 13 in actuating tube 11 and finally out of discharge opening 20 at the top end of the latter.

As will also be appreciated it is not critical that the displacement of the moving parts be in strictly straight alignment or occurs at a slight angle, i.e. with tilting of one or the other of the moving parts. For sealing gasket 8 easily permits a slight tilting of the valve body 2 with uneven biassing of valve spring 7.

In this embodiment of the discharge system, the upper actuating tube portion 11*b* bears a cap 40 which is preferably made integrally therewith from such sufficiently stiff material as polyethylene, polypropylene or PVC. This cap 40 has a lid part 41 which is separated over a major portion of its circumference, for instance two thirds thereof, from the cap sidewall 42 by an arcuate slot 43, and is fastened with its lower rim part 44 in a conventional manner on the upper annular rim 1*a* of the wall of can 1. The lid part 41 can bear an elevated pressure knob 45 preferably adjacent the center of the arcuate slot 43.

When finger pressure is exerted on the pressure knob 45, the lid part 41 will be tilted with its free side 41*a* downward while being held in position at its opposite side 41*b* where it is integral with the cap sidewall 42. Downward bending of lid part 41 leads to transmission of a downwardly directed axial force component on upper tube portion 11*b* and on to the foldable wall zone 12 which will be compressed strongly on the side thereof corresponding to side 41*a* of lid part 41, and less on its opposite side. This will, however, suffice to form an annular gap between obturating head 18 and the seat 13*b* at the top end of actuating tube portion 11*b*, thus opening slightly the discharge orifice 20. It is quite immaterial for the discharge of foam or the like that the gap forming the orifice is not uniform, but will be wider on the side thereof corresponding to side 41*a* of lid part 41 and narrower on the opposide side.

A similar opening effect can also be achieved by applying finger pressure transversely on the upper tube portion 11*b*, inclining the latter, preferably in the direction from side 41*b* to side 41*a* of lid part 41.

Further finger pressure on pressure knob 45 will then cause, after maximal, though ununiform compression of wall zone 12 has been achieved, a corresponding inward displacement of valve body 2 with corresponding opening of the discharge valve 3.

When finger pressure on knob 45 is relieved or ceases, the discharge valve 3 will first close, the closing of discharge orifice 20 following shortly thereafter.

In the embodiment of a discharge system shown in FIG. 8 the lid 51 of the cap 50 which is integral with actuating tube portion 11*b*, is not slotted but has a reduced diameter and/or grooving 53 in an arcuate zone about a major portion, e.g. two thirds or three quarters, of its circumference near its junction with cap sidewall 52. The lid 51 bears a pressure knob 55, and its operation is similar to that of lid part 41 in the embodiment shown in FIGS. 6 and 7.

In the embodiment shown in FIG. 9 the lid part 61 of cap 60 is conically tapered and of considerably reduced thickness, so that finger pressure applied laterally to the actuating tube portion 11*b* or perpendicularly on to the conical part 61 suffices to deform the latter with slight tilting of the actuating tube portion 11*b*. Operation of the system is the same as in the systems shown in FIGS. 6, 7 and 8.

In the embodiments shown in FIGS. 8 and 9, the foldable wall zone 12 of the actuating tube 11 is enclosed by a sleeve 56, which prevents a folding of this wall zone in outward direction. This affords a somewhat harder spring action of the wall zone 12, and also ensures a somewhat better force transmission during operation from the slightly tilted upper actuating tube portion 11*b* via the inwardly folded wall zone 12 to the valve body 2.

In the embodiment of the discharge system according to the invention shown in FIG. 10 the entire actuating tube 11 is surrounded by a sleeve or jacket 71, the outer mantle surface of which is of frustoconical shape with the apex being above the discharge orifice 20. This sleeve 71 is held in position relative to the upper actuating tube portion 11*b* by means of a circumferential rib 72 which protrudes into a corresponding annular groove 73 provided in the internal wall 71*a* of sleeve 71. This prevents axial sliding of upper actuating tube portion 11*b* in sleeve 71. At its inner end, sleeve 71 bears a conically outwardly and downwardly widening flange part 74 which engages, with its conical surface 74*a*, the underside of a lid part 75 of a cap 70, which lid part 75 has a central opening 75*a* which is of sufficiently wide diameter to permit considerable tilting of the upper portion of flange part 74 and of the sleeve 71 which protrudes therefrom to the outside of opening 75*a*.

When a tilting force is exercised on the sleeve 71 by lateral finger pressure, then sleeve 71 as well as the actuating tube 11 are tilted slightly. Thereby, as the lower actuating tube portion 11*a* is held in position on the top end of valve body 2, and the latter maintains its position relative to actuating tube 11 owing to the superior strength of valve spring 7, the lower tube portion 11*a* is caused to slide slightly upward in tilted sleeve 71, and as the upper tube portion 11*b* is somewhat lowered by the tilting of sleeve 71, which it must follow due to the firm connection therewith assured by annular rib 73, foldable wall portion 12 is folded inwardly. At the same time, stiff obturating member 16 is held in position in lower tube portion 11*a* and obturating head 18 will be lifted into opening position off seat 13*b*.

When tilting of sleeve 71 and upper actuating tube portion 11*b* is further increased beyond complete compression of the wall zone 12, at least on the side toward which tilting is effected, then downward pressure on valve body 2 will increase until the bias of valve spring 7 is overcome and the discharge valve 3 opens.

In order to augment the inwardly directed movement of sleeve 71 and upper tube portion 11*b*, the conically tapered upper face 74*a* of flange 74 can bear projections 76 along its peripheral zone.

Of course, the sleeve 71 in this embodiment can also be omitted and the flange 74 can be directly attached to the actuating tube 11, however such attachment or connection must be above the foldable wall zone 12, i.e. near the bottom end of the upper tube portion 11*b*.

In order to prevent excessive tilting of the valve body 2 during the initial opening phase of discharge orifice 20, it is recommended that the diameter of the inner wall of sleeve 71 near the lower end of the latter be slightly widened toward that lower end, beginning at or just below the lower end of foldable wall zone 12, as indicated in phantom lines at 77 in FIG. 10.

It is advantageous to make all parts of the actuating device and most parts of the discharge valve of synthetic resin material. Sleeve 56 can be made of metal, and valve spring 7 is conventionally made of steel wire.

An optimal embodiment of the elastically flexible wall zone 12 should satisfy several requirements. It should be easy to manufacture by injection-molding techniques, which involves easy removal of a mold core, it should permit easy mounting and prevent disengagement of the holding pins of the obturating member, and it should provide for a satisfactory spring effect (elasticity) which insures hermetic closure of the discharge orifice 20 even when the wall zone 12 is pretensioned over a prolonged period of storage while mounted on the discharge valve of a filled pressurized can.

To satisfy these requirements, a preferred structure of the wall zone 12 and the adjacent zone there below containing the annular groove 17*a* comprises a lower sidewall 17*b* of annular groove 17*a* which sidewall extends in a plane substantially at a right angle to the longitudinal axis of obturating member 11.

The upper sidewall 17*c* of annular groove 17*a* is preferably part of a cone mantle having an inclination of about 45° relative to the said longitudinal axis. This permits withdrawal of the mold core upwardly with a force which is several times that force which is exercised on the holding pins 17 of obturating member 16 in axial direction when the discharge orifice 20 opens or closes.

I claim:

1. A self-sealing actuating device adapted for being mounted on the valve body, having an outlet channel, of a self-closing discharge valve of a pressurized container from which a liquid product is to be dispensed with the aid of a propellant in liquid, pasty or foamy condition, which actuating device opens automatically when an external part thereof is moved in a given direction, and comprises (a) as said external part, a tubular actuating member having two open ends, a first one of which is destined to register with the said outlet channel, when said actuating device is mounted on said valve body, the other open end constituting a discharge orifice of said device; and a tubular passage connecting said two open ends;

(b) an obturating member lodged stationary in said tubular passage and having an obturating head for obturating said discharge orifice hermetically from the outside, when said tubular actuating member is in a closed position, (c) anchoring means extending radially in said tubular passage in an anchoring zone thereof axially spaced from said other open end of said actuating member, and holding said obturating member and said actuating member in engagement with one another in said zone, and (d) spring means associated with said tubular actuating member and adapted for biassing said actuating member toward said closed position when said actuating member is brought into an open position;

said actuating member being axially displaceable relative to said obturating member, between said anchoring zone and said other second open end thereof, between said open and said closed positions, whereby, when said tubular actuating member is moved toward the open position, by an axial force directed away from said discharge orifice, against bias applied to said tubular member by said spring means being compressed, said obturating head protrudes out of said discharge orifice and frees said discharge orifice in the form of an annular gap.

2. An actuating device as defined in claim 1, wherein said tubular member comprises an elastically foldable wall zone acting as said spring means, whereby, upon force being applied to said actuating member to disengage said obturating head from said discharge orifice, said foldable wall zone is compressed with corresponding axial shortening of said actuating member.

3. An actuating device as defined in claim 2, wherein said anchoring means rigidly anchors said obturating member in said tubular actuating member, said anchoring means engaging said actuating member in a zone thereof on the side of said foldable wall zone remote from said discharge orifice.

4. An actuating device as defined in claim 1, wherein each of said actuating member and said obturating member is an integral part made of synthetic plastics material.

5. An actuating device as defined in claim 2, wherein said obturating member is integrally made of synthetic hard plastics material, and wherein said tubular actuating member consists essentially of two rigid tubular parts each made integrally of synthetic hard plastics material, and of an annular wall part made of elastically deformable synthetic or natural plastics material, one of said rigid tubular parts comprising at one end thereof said discharge orifice, and having its other end joined to one end of said annular wall part, the other end of said annular wall part being joined to the other rigid tubular part.

6. A self-sealing actuating device as defined in claim 1, wherein said tubular actuating member comprises an elastically foldable wall zone acting as said spring means whereby, upon force being applied to said actuating member to disengage said obturating head from said discharge orifice, said foldable wall zone is compressed with corresponding axial shortening of said actuating member, said anchoring means rigidly anchoring said obturating member in said tubular actuating member, said anchoring means engaging said actuating member in a zone thereof on the side of said foldable wall zone remote from said discharge orifice.

7. A discharge system comprising (I) a self-closing discharge valve for use with a pressurized container, from which container a liquid product is to be dispensed with the aid of a propellant in liquid, pasty or foamy condition, which discharge valve comprises a valve body having an outlet channel, a valve seat, and a valve spring means biassing said valve body into closing position on said valve seat; and (II) a self-sealing actuating device mounted on said valve body, and comprising (a) a tubular actuating member having two open ends, one of which is destined to register with the said outlet channel, the other open end constituting the discharge orifice of said device; and a tubular passage connecting said two open ends;

(b) an obturating member lodged stationary in said tubular passage and having an obturating head for obturating said discharge orifice hermetically from the outside, when said actuating member device is in a closed position, (c) anchoring means extending radially in said tubular passage in an anchoring zone thereof axially spaced from said other open end of said actuating member, and holding said obturating member and said actuating member in engagement with one another in said zone, and (d) actuating device spring means associated with said tubular actuating member and adapted for biassing said actuating member towards said closed position;

said actuating member being axially displaceable relative to said obturating member, in the range between said anchoring zone and said other second open end thereof, between said open and said closed positions, whereby, when said tubular actuating member is moved toward the open position, by an axial force directed away from said discharge orifice, said obturating head protrudes out of said discharge orifice with compression tensioning of said actuating device spring means, and frees said discharge orifice in the form of an annular gap.

8. A discharge system as defined in claim 7, wherein the strength of said valve spring means and the strength of said actuating device spring means are so proportioned relative to one another that disengagement of said valve body from said valve seat occurs, against the action of said valve spring means, at the earliest when said obturating head frees said discharge orifice with the formation of said annular gap.

9. A discharge system as defined in claim 7, wherein the strengths of said valve spring means and said actuating device spring means are so proportioned relative to each other that disengagement of said valve body from said valve seat occurs only after said obturating head frees said discharge orifice with the formation of said annular gap.

10. A discharge system as defined in claim 7, wherein said tubular member comprises an elastically foldable wall zone acting as said actuating device spring means, whereby, upon force being applied to said actuating member to disengage said obturating head from said discharge orifice, said foldable wall zone is compressed with corresponding axial shortening of said actuating member; said anchoring means rigidly anchoring said obturating means in said tubular actuating member, said anchoring means engaging said actuating member in a zone thereof on the side of said foldable wall zone remote from said discharge orifice;

while, upon further force being applied to said actuating member in the direction toward said valve body, said tubular actuating member will move said valve body against the action of said valve spring means to open said discharge valve.

11. A discharge system as defined in claim 10, wherein said tubular actuating member comprises an outer hull about said tubular passage and contact means connected with said outer hull in the region thereof between said discharge orifice and said elastically foldable wall zone, said contact means being finger-depressable.

12. A discharge system as defined in claim 11, wherein said discharge valve comprises mounting means adapted for mounting said discharge valve onto a pressurized container and said contact means is a finger cap having a circumference, a part of which is rigidly connected to said mounting means, whereby finger-pressure exerted on said cap moves said actuating member with tilting and compression of said foldable wall zone toward said open position, and wherein said valve body of said discharge valve is tiltable, and tilting of said valve body under pressure of said actuating member occurs after full compression of said foldable wall zone causing opening of said discharge valve.

13. A discharge system as defined in claim 12, wherein said tubular actuating member and said finger cap are integrally made from synthetic plastics material.

14. A discharge system as defined in claim 12 or 13, wherein said cap comprises a roof portion and a cap side wall, the periphery of said roof portion being connected with said side wall by a bridging segment, the remainder of said roof portion and side wall being separated from one another by an arcuate slot.

15. A discharge system as defined in claim 10, wherein said tubular actuating member comprises an outer hull about said tubular passage and contact means connected with said outer hull in the region thereof between said discharge orifice and said elastically foldable wall zone, said contact means being finger-depressable, and wherein said discharge valve comprises mounting means adapted for mounting said discharge valve onto a pressurized container and said contact means is a finger cap having a circumference, a part of which is rigidly connected to said mounting means, whereby finger-pressure exerted on said cap moves said actuating member with tilting and compression of said foldable wall zone toward said open position, and wherein said valve body of said discharge valve is tiltable, and tilting of said valve body under pressure of said actuating member occurs after full compression of said foldable wall zone causing opening of said discharge valve.

* * * * *